US007376381B1

(12) United States Patent
Black

(10) Patent No.: US 7,376,381 B1
(45) Date of Patent: May 20, 2008

(54) METHOD AND APPARATUS FOR PRINTING IMAGE REPLACEMENT DOCUMENTS

(75) Inventor: Bruce L. Black, Canton, MI (US)

(73) Assignee: Unisys Corporation, Blue Bell, PA (US)

( * ) Notice: Subject to any disclaimer, the term of this patent is extended or adjusted under 35 U.S.C. 154(b) by 484 days.

(21) Appl. No.: 11/153,697

(22) Filed: Jun. 15, 2005

(51) Int. Cl.
*G03G 21/00* (2006.01)
*B41J 13/10* (2006.01)

(52) U.S. Cl. ..... 399/389; 399/393; 271/8.1; 271/9.05; 271/9.06

(58) Field of Classification Search ..... None
See application file for complete search history.

(56) References Cited

U.S. PATENT DOCUMENTS 4,930,089 A * 5/1990 Hatakeyama et al. ..... 358/1.5
5,596,399 A * 1/1997 Dempsey et al. ..... 399/45
5,946,527 A * 8/1999 Salgado et al. ..... 399/82
6,456,801 B1 * 9/2002 Sakurai ..... 399/16
2005/0093222 A1 * 5/2005 Ouchi et al. ..... 271/9.09
2006/0255531 A1 * 11/2006 Azzopardi et al. ..... 271/171

* cited by examiner

*Primary Examiner*—Daniel J. Colilla
*Assistant Examiner*—'Wynn' Q Ha
(74) *Attorney, Agent, or Firm*—Richard J. Gregson; Robert P. Marley; Brooks & Kushman, P.C.

(57) ABSTRACT

A high performance printing system includes a paper tray for holding the blank paper prior to printing. The printer engine demands that the paper size be selected from a limited set of allowable paper sizes. A paper guide mechanism installed in the paper tray has a configuration that operates to guide a paper size having a reduced width relative to a particular allowed paper size. The paper guide mechanism allows reduced width paper to be used in the paper tray, essentially without otherwise adjusting the printing system, such that the printer engine sees the paper size as a particular allowed paper size when a reduced width paper is being used for printing.

16 Claims, 5 Drawing Sheets

METHOD AND APPARATUS FOR PRINTING IMAGE REPLACEMENT DOCUMENTS

BACKGROUND OF THE INVENTION

1. Field of the Invention

The invention relates to high performance printing systems capable of printing magnetic ink character recognition (MICR) documents, to check truncation and to image replacement documents.

2. Background Art

An existing high performance printing system, for example, a high performance laser printer, includes a printer engine and a printer controller. The printer controller receives page data representing printed pages from a host computer. The printer controller arranges the printed pages for handling by the printer engine to print the pages. A typical high performance printing system includes one or more paper trays for holding the blank paper prior to printing. The printer engine demands that the paper size for a tray be selected from a limited set of allowable paper sizes depending on the printer engine implementation.

In check truncation, a paper check is processed by a document processing system and the paper check is converted to an electronic form. This electronic information may later be used to create a substitute check in a process called check reconverting or to create an image replacement document. It is appreciated that check truncation will eventually be a process in widespread use.

Some existing high performance printing systems are not suitable for printing image replacement documents because the printer engine implementation does not accommodate the image replacement document paper. For example, 8.5 inch by 17 inch return IRD paper is not an allowable paper size and cannot normally be fed and printed by the printing system.

For the foregoing reasons, there is a need for an improved apparatus and method for printing image replacement documents that addresses limitations associated with printer engine implementation.

SUMMARY OF THE INVENTION

It is an object of the invention to provide an improved apparatus and method for printing image replacement documents that incorporates a modification to the printer's standard paper trays to allow use of return IRD paper.

In carrying out the invention, a method of printing image replacement documents is provided. The method comprises providing a high performance printing system capable of printing magnetic ink character recognition (MICR) documents. The printing system includes a printer engine and a printer controller. The printer controller receives page data representing printed pages from a host computer and arranges the printed pages for handling by the printer engine to print the pages. The printing system further includes a paper tray for holding the blank paper prior to printing. The printer engine demands that the paper size be selected from a limited set of allowable paper sizes.

The method further comprises installing a paper guide mechanism in the paper tray. The paper guide mechanism has a configuration that operates to guide a paper size having a reduced width relative to a particular allowed paper size. The paper guide mechanism thereby allows the reduced width paper to be used in the paper tray essentially without otherwise adjusting the printing system. The printer engine sees the paper size as the particular allowed paper size when in actuality the reduced width paper is being used for printing.

In a preferred implementation, the paper guide mechanism configuration operates to guide paper having a size of about 8.5 inches by 17 inches for creating image replacement documents. Further, the printer engine sees the paper size as 11 inches by 17 inches when the reduced width paper is being used for printing. Accordingly, only margin settings must be changed in the software application and the printing system is made to accommodate the reduced width paper even though the printer engine implementation may not be designed to handle the reduced width paper.

Further, in carrying out the invention, an apparatus is provided. The apparatus comprises a high performance printing system, and a paper guide mechanism. The high performance printing system is capable of printing magnetic ink character recognition (MICR) documents. The printing system includes a printer engine and a printer controller. The printer controller receives page data representing printed pages from a host computer and arranges the printed pages for handling by the printer engine to print the pages. The printing system further includes a paper tray for holding the blank paper prior to printing. The printer engine demands that the paper size be selected from a limited set of allowable paper sizes.

The paper guide mechanism is installed in the paper tray. The paper guide mechanism has a configuration that operates to guide a paper size having a reduced width relative to a particular allowed paper size. The paper guide mechanism thereby allows the reduced width paper to be used in the paper tray essentially without otherwise adjusting the printing system. The printer engine sees the paper size as the particular allowed paper size when the reduced width paper is being used for printing.

DETAILED DESCRIPTION OF THE PREFERRED EMBODIMENTS

Figure 1:
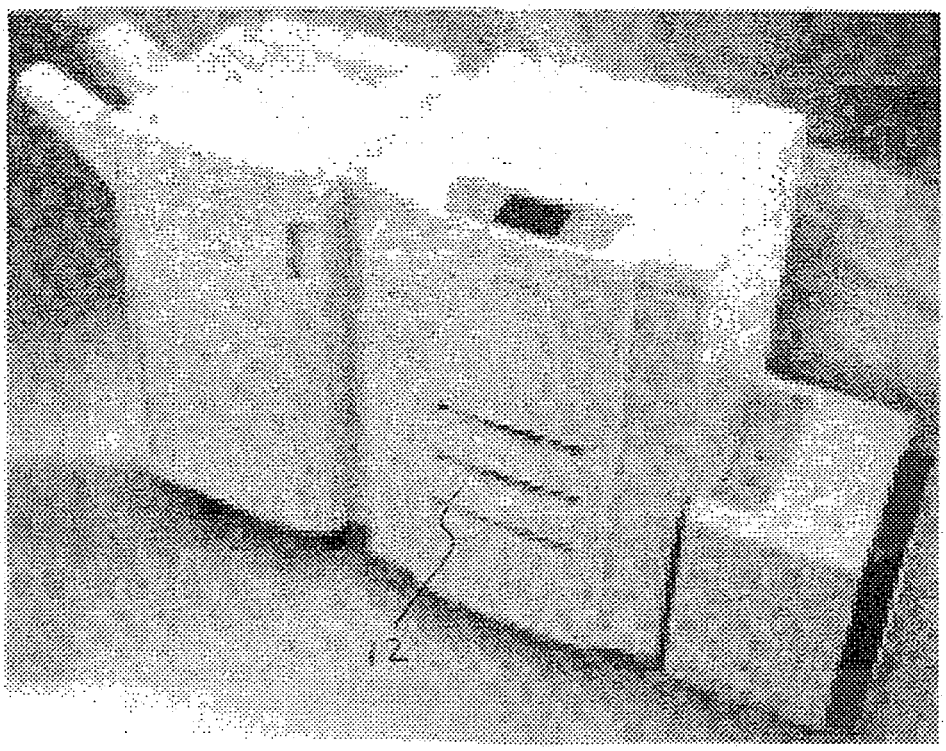
FIG. 1 illustrates a high performance printing system capable of printing magnetic ink character recognition (MICR) documents and having modifications made to the printer's standard paper trays to allow use of reduced width paper for printing image replacement documents.

FIG. 1 illustrates a high performance printing system at 10. Printing system 10 is capable of printing magnetic ink character recognition (MICR) documents. As shown, printing system 10 includes several paper trays 12.

Figure 9:
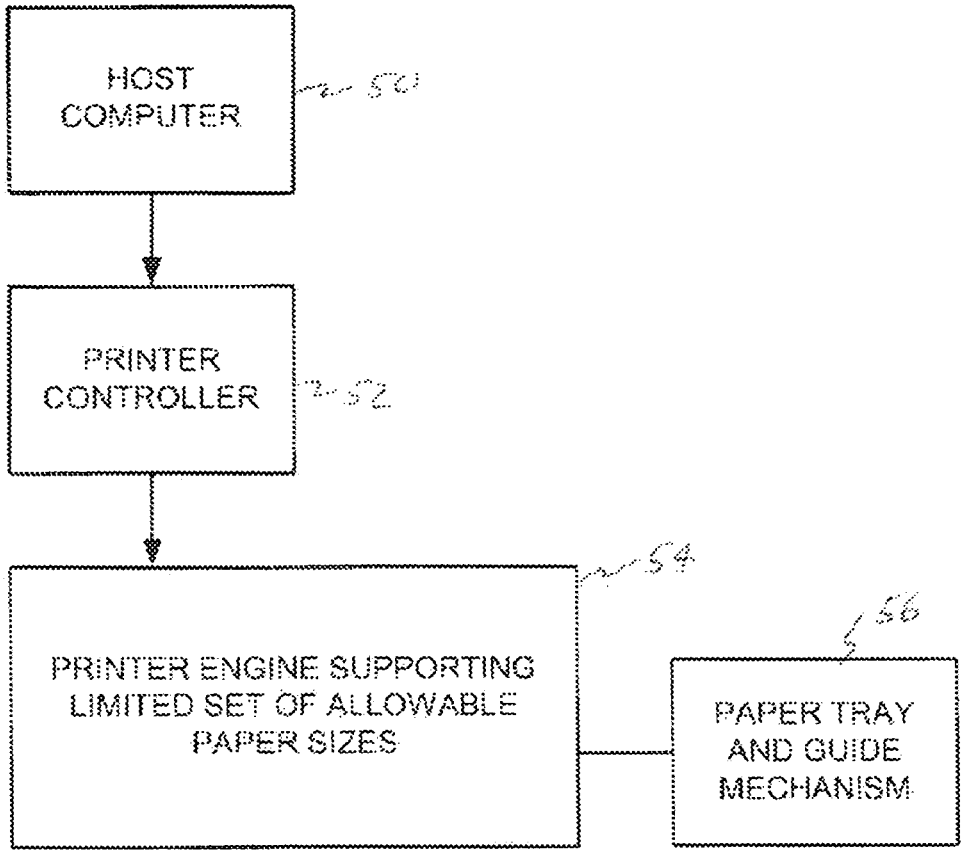
FIG. 9 illustrates a host computer connected to a printing system including a printer controller, printer engine, and paper tray incorporating a guide mechanism.

FIG. 9 is a functional block diagram depicting operation of the printing system 10. A host computer 50 sends pages to the printer controller 52 of the printing system 10. Printer controller 52 receives page data representing printed pages and arranges the printed pages for handling by the printer engine 54. Printer engine 54 demands that the paper size be selected from a limited set of allowable paper sizes. According to embodiments of the invention, a paper tray and guide mechanism is indicated at block 56. The paper guide mechanism is installed in the paper tray and has a configuration that operates to guide a paper size having a reduced width relative to a particular allowed paper size. This allows the reduced width paper to be used in the paper tray, essentially without otherwise adjusting the printing system, such that the printer engine 54 sees the paper size as a particular allowed paper size when in actuality the reduced width paper is being used for printing.

With reference to FIGS. 2-7, the preferred embodiment of the paper guide mechanism is illustrated. Aluminum sheet metal guides have been developed, manufactured, and are intended to be mounted in existing printers allowing 8.5 inch by 17 inch return IRD paper to be fed and printed. The guides allow the printer trays to be set to use 11 inch by 17 inch size ledger paper, yet provide the capability to use 8.5 inch by 17 inch return IRD paper instead with only margin settings needing to be changed in the software application. These guides add capability to the existing printer that could not previously exist.

Figure 2:
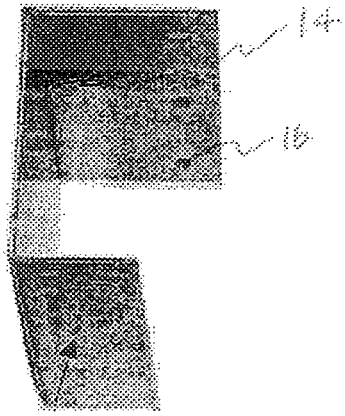
FIGS. 2-7 illustrate a preferred embodiment of the paper guide mechanism installation in the paper tray, with the paper guide mechanism being in the form of opposed paper guides with each guide including first and second guide members positioned along the respective edge of the paper in the paper tray.
Figure 3:
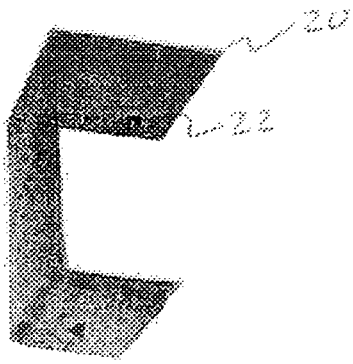
Figure 4:
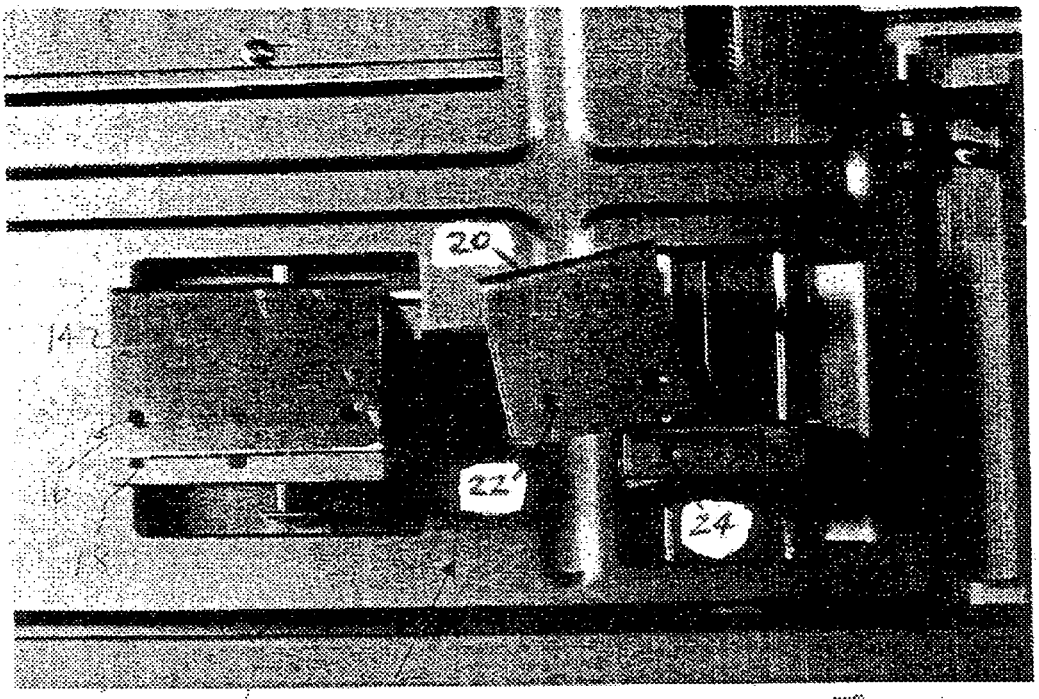
Figure 5:
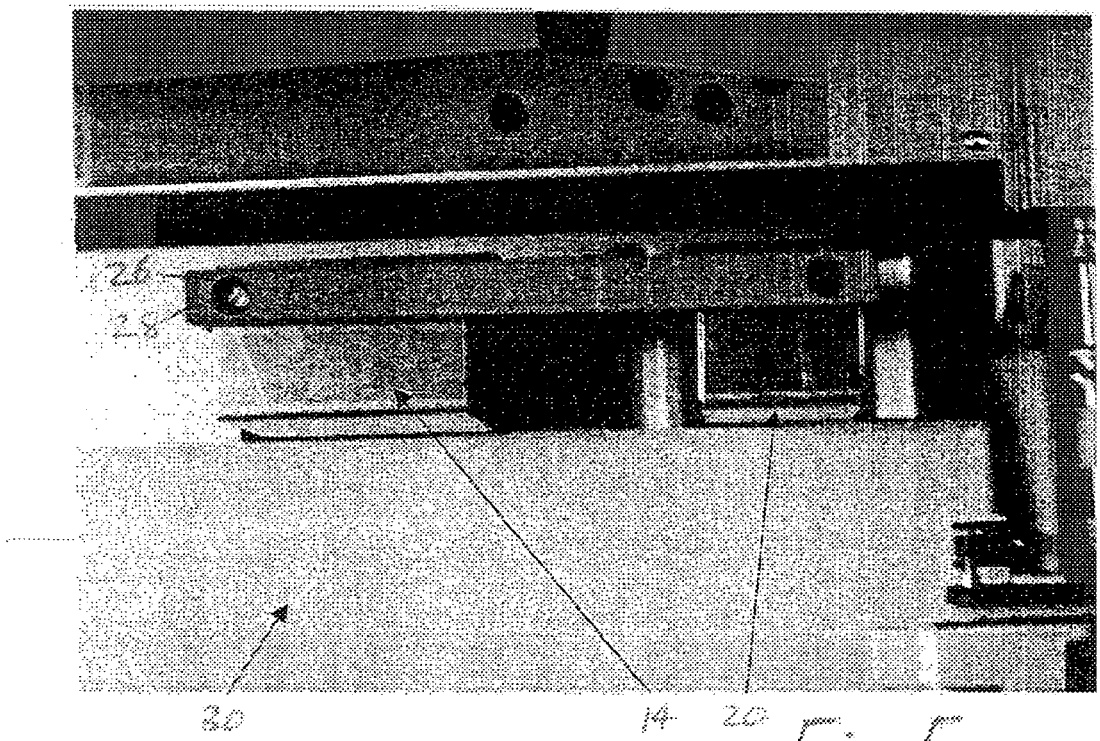
Figure 6:
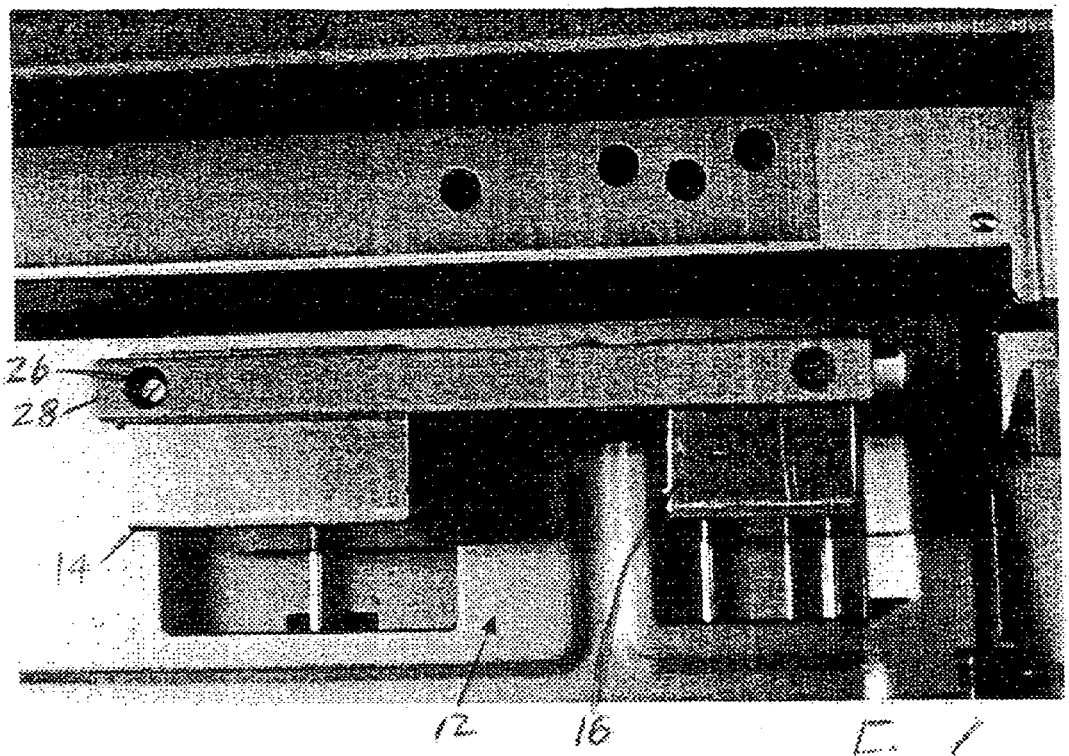

FIG. 2 shows large guide 14 with mounting holes 16. FIG. 3 shows small guide 20 with mounting holes 22. Each side of the paper tray receives both a small and a large guide which function as first and second guide members positioned along the respective edge of the paper in the paper tray.

With reference to FIGS. 4-7, the following describes installation of the large and small guides. The description explains the installation of large and small guides into a single paper tray. It is appreciated that additional trays may also be fitted with appropriate paper guide mechanisms having appropriate size and shape.

Figure 7:
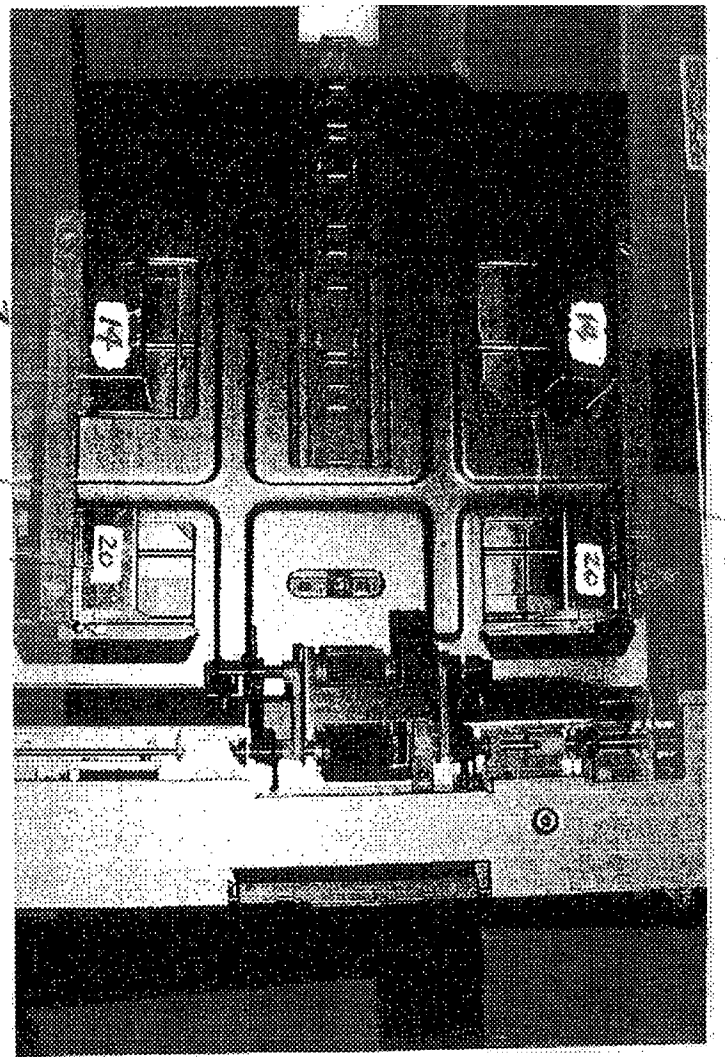

To install the large and small guides into a paper tray, first, the tray is removed and tray guide handles 28 are removed. A small guide 20 and a large guide 14 are mounted under one of the tray guide handles 28, and securing screws 26 are left slightly loose. A ream of unpackaged letter size paper is placed in the tray and allows sliding of the side guides together using the paper to align the new guides. Thereafter, screws 26 are tightened. The same procedure is followed for a small guide 20 and a large guide 14 at the other guide handle 28 on the other side of the paper tray. Once a large guide and the small guide are installed on each side of the paper tray, the result is shown in FIG. 7.

Figure 8:
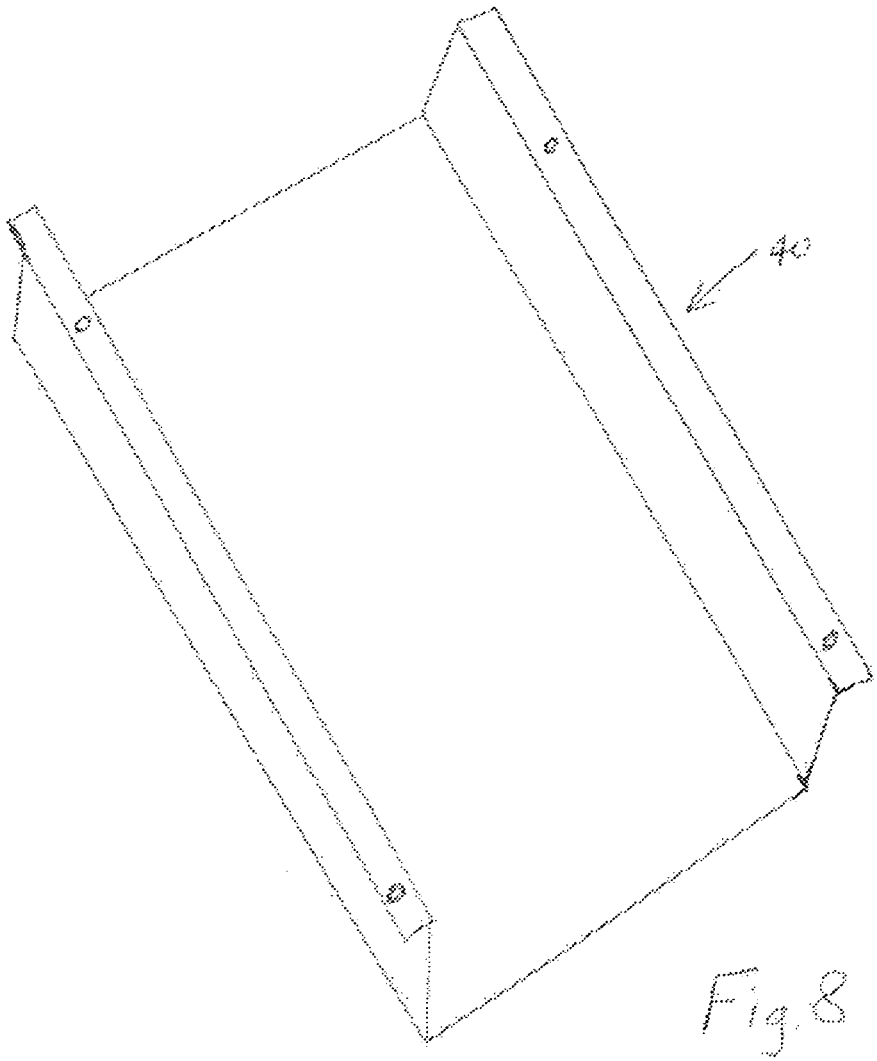
FIG. 8 illustrates an alternative embodiment of the paper guide mechanism taking the form of a guide tray for mounting in the paper tray.

FIG. 8 illustrates an alternative embodiment paper guide mechanism taking the form of a guide tray 40. Guide tray 40 defines the pair of opposed paper guides at opposite sides of the paper stack, which is placed in guide tray 40, so as to fit the paper tray to paper having reduced width essentially without otherwise adjusting the paper tray.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method of printing image replacement documents, the method comprising:

providing a high performance printing system capable of printing magnetic ink character recognition (MICR) documents, the printing system including a printer engine and a printer controller, the printer controller receiving page data representing printed pages from a host computer and arranging the printed pages for handling by the printer engine to print the pages, the printing system further including a paper tray for holding the blank paper prior to printing, wherein the printer engine demands that the paper size be selected from a limited set of allowable paper sizes;

installing a paper guide mechanism in the paper tray, the paper guide mechanism having a configuration that operates to guide a paper size having a reduced width relative to a particular allowed paper size; and the paper guide mechanism thereby allowing the reduced width paper to be used in the paper tray, essentially without otherwise adjusting the printing system, such that the printer engine sees the paper size as the particular allowed paper size when the reduced width paper is being used for printing.

2. The method of claim 1 wherein the paper guide mechanism configuration operates to guide paper having a width of about 8.5 inches.

3. The method of claim 2 wherein the paper guide mechanism configuration operates to guide paper having a size of about 8.5 inches by 17 inches for creating image replacement documents.

4. The method of claim 3 wherein the printer engine sees the paper size as 11 inches by 17 inches when the reduced width paper is being used for printing.

5. The method of claim 1 wherein the printer engine sees the paper size as 11 inches by 17 inches when the reduced width paper is being used for printing.

6. The method of claim 1 wherein the paper guide mechanism comprises:

a pair of opposed paper guides mounted in the paper tray on opposite sides of the paper stack so as to fit the paper tray to paper having a reduced width essentially without otherwise adjusting the paper tray.

7. The method of claim 6 wherein each paper guide includes first and second guide members positioned along the respective edge of the paper in the paper tray.

8. The method of claim 1 wherein the paper guide mechanism comprises:

a guide tray mounted in the paper tray, the guide tray defining a pair of opposed paper guides on opposite sides of the paper stack, which is placed in the guide tray, so as to fit the paper tray to paper having a reduced width essentially without otherwise adjusting the paper tray.

9. An apparatus comprising:

a high performance printing system capable of printing magnetic ink character recognition (MICR) documents, the printing system including a printer engine and a printer controller, the printer controller receiving page data representing printed pages from a host computer and arranging the printed pages for handling by the printer engine to print the pages, the printing system further including a paper tray for holding the blank paper prior to printing, wherein the printer engine demands that the paper size be selected from a limited set of allowable paper sizes;

a paper guide mechanism installed in the paper tray, the paper guide mechanism having a configuration that operates to guide a paper size having a reduced width relative to a particular allowed paper size; and the paper guide mechanism thereby allowing the reduced width paper to be used in the paper tray, essentially without otherwise adjusting the printing system, such that the printer engine sees the paper size as the particular allowed paper size when the reduced width paper is being used for printing.

10. The apparatus of claim 9 wherein the paper guide mechanism configuration operates to guide paper having a width of about 8.5 inches.

11. The apparatus of claim 10 wherein the paper guide mechanism configuration operates to guide paper having a size of about 8.5 inches by 17 inches for creating image replacement documents.

12. The apparatus of claim 11 wherein the printer engine sees the paper size as 11 inches by 17 inches when the reduced width paper is being used for printing.

13. The apparatus of claim 9 wherein the printer engine sees the paper size as 11 inches by 17 inches when the reduced width paper is being used for printing.

14. The apparatus of claim 9 wherein the paper guide mechanism comprises:

a pair of opposed paper guides mounted in the paper tray on opposite sides of the paper stack so as to fit the paper tray to paper having a reduced width essentially without otherwise adjusting the paper tray.

15. The apparatus of claim 14 wherein each paper guide includes first and second guide members positioned along the respective edge of the paper in the paper tray.

16. The apparatus of claim 9 wherein the paper guide mechanism comprises:

a guide tray mounted in the paper tray, the guide tray defining a pair of opposed paper guides on opposite sides of the paper stack, which is placed in the guide tray, so as to fit the paper tray to paper having a reduced width essentially without otherwise adjusting the paper tray.

* * * * *